US008870029B2

(12) United States Patent
Stanojlovic et al.

(10) Patent No.: US 8,870,029 B2
(45) Date of Patent: Oct. 28, 2014

(54) HEATING AND DISPENSING APPARATUS

(76) Inventors: Mileta Stanojlovic, Toronto (CA); Dragica Stanojlovic, Toronto (CA)

( * ) Notice: Subject to any disclaimer, the term of this patent is extended or adjusted under 35 U.S.C. 154(b) by 82 days.

(21) Appl. No.: 13/604,744

(22) Filed: Sep. 6, 2012

(65) Prior Publication Data

US 2014/0061241 A1 Mar. 6, 2014

(51) Int. Cl.
*B67D 7/80* (2010.01)

(52) U.S. Cl.
USPC .... 222/146.5; 222/54; 222/146.2; 222/386.5; 222/394; 219/382; 219/421; 219/424; 392/441

(58) Field of Classification Search
USPC ..... 222/146.2, 146.5, 129, 386.5, 389, 394, 222/399, 401, 334, 54; 219/385, 420–430; 141/82; 392/441
See application file for complete search history.

(56) References Cited

U.S. PATENT DOCUMENTS 872,561 A * 12/1907 Fess ..... 134/4
3,368,244 A * 2/1968 Mueller ..... 222/162
3,917,122 A * 11/1975 Swan et al. ..... 222/146.5
4,150,770 A * 4/1979 Wieland et al. ..... 222/146.5
4,773,784 A * 9/1988 Mann ..... 401/1
5,123,569 A * 6/1992 Lindner ..... 222/56
5,935,468 A * 8/1999 Nishino et al. ..... 219/438
6,627,072 B1 * 9/2003 Ridge ..... 210/149
6,935,535 B2 * 8/2005 Pandolfi et al. ..... 222/146.5
7,315,691 B1 1/2008 Palkie et al.
8,567,644 B2 * 10/2013 Martinez de San Vicente Oliveras ..... 222/146.5

* cited by examiner

*Primary Examiner* — Frederick C Nicolas
(74) *Attorney, Agent, or Firm* — Ostrolenk Faber LLP

(57) ABSTRACT

A heating and dispensing apparatus has a first portion defining a main, active reservoir for the molten material to be dispensed. A second portion has a heater and a seat for preheating a supply of replacement molten material. The main reservoir is pressurized, such that molten material therein is urged to flow out the outflow passageway when the valve is opened. The apparatus includes a heated receptacle support structure positioned to hold a disposable receptacle underneath the outflow. The outflow is mounted to the lid of the main reservoir, and can be cleaned when the lid is removed. The outflow outlet and the receptacle support structure are both located in exposed positions to facilitate cleaning. The pre-heat, main reservoir, outflow, and receptacle support structure are heated by a single heating system, by thermal conduction. The outside of the unit is kept substantially free of unnecessary obstructions to facilitate cleaning.

26 Claims, 7 Drawing Sheets

HEATING AND DISPENSING APPARATUS

FIELD OF INVENTION

Figure 1:
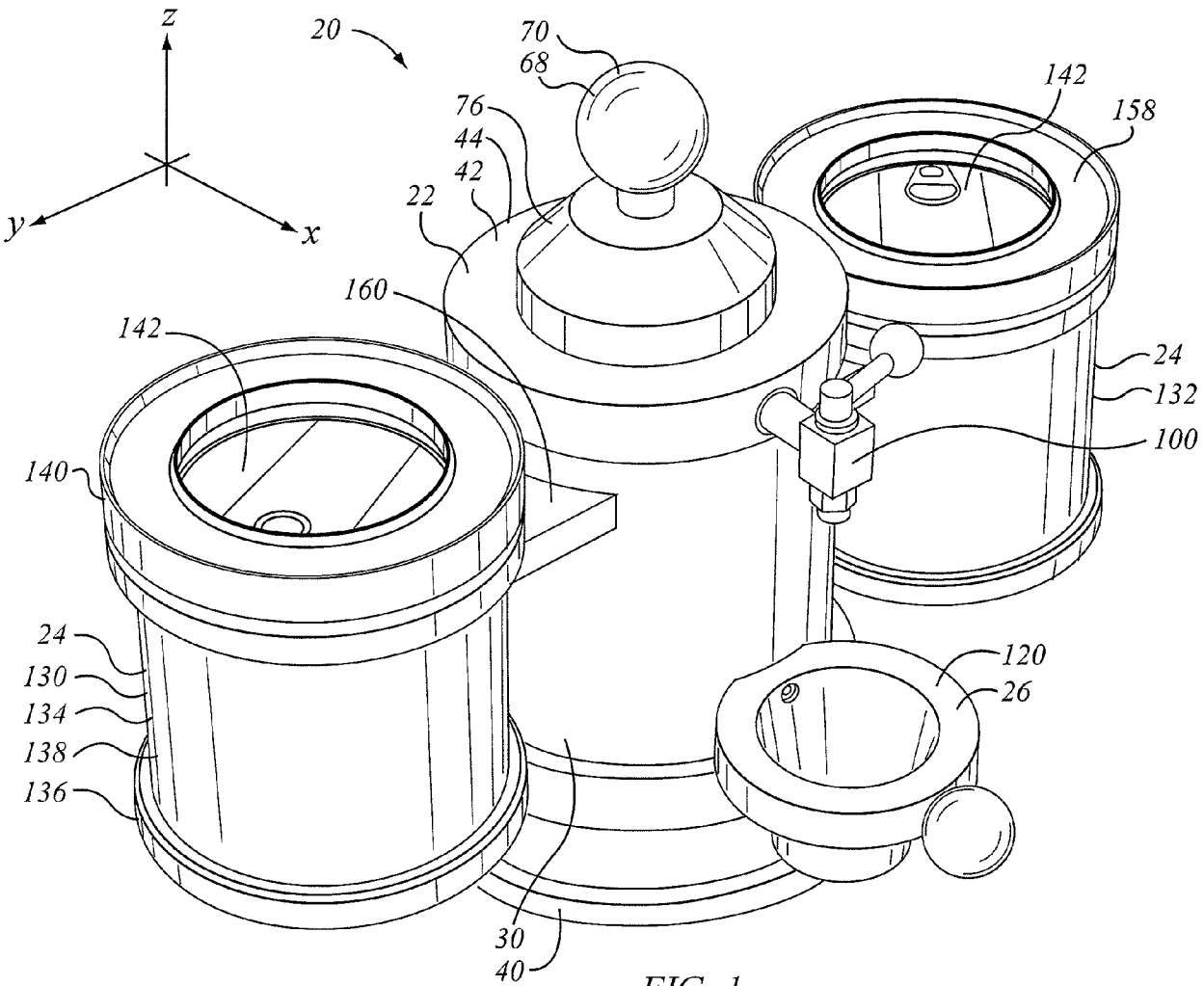

This Application relates to apparatus for heating and dispensing meltable materials generally, and in particular in respect of heating and dispending depilatory wax.

BACKGROUND OF THE INVENTION

In a conventional method, depilatory wax is heated in a container. The attendant uses a spatula, which may have a form similar to a wooden tongue-depressor, to dispense the depilatory wax. Each time wax is taken from the reservoir a new spatula is to be used to prevent the spread of disease. There are many problems that arise from this approach. First, maintenance of proper hygiene depends strongly on the diligence of the attendant. Second, even if diligent, the process may tend to result in the creation of a good deal of waste. The subject is addressed in U.S. Pat. No. 7,315,691 of Palkie, for example.

SUMMARY OF INVENTION

The following summary may introduce the reader to the more detailed discussion to follow. The summary is not intended to, and does not, limit or define the claims.

In an aspect of the invention there is a depilatory wax dispenser assembly. It has a first accommodation, a second accommodation, and a heater. The first accommodation defines a chamber in which to contain molten wax. The first chamber having a discharge through which molten wax may flow upon demand. The second accommodation defines a seat in which to heat a reserve supply of molten wax for replenishing the chamber. The heater is mounted to the second accommodation. The dispenser has a heat flow path from the heater to the second accommodation, and therefrom to the first accommodation.

In a feature of that aspect of the invention the second accommodation is linked to the first accommodation by a thermal conduction bridge. In another feature, the assembly includes a third accommodation defining a second seat in which to heat a second reserve supply of wax for replenishing the chamber. In a further feature, the assembly includes a second heater mounted to the second seat, and the second heater also indirectly heats the first accommodation. In another feature, the first and second seats are mounted symmetrically to the first accommodation. In still another feature, the first accommodation has a body defining a surrounding wall of the chamber. The second accommodation is mounted adjacent to the first accommodation. The body has a lower region and an upper region; and the thermal conduction bridge is mounted to the upper region of the body.

In still another feature, the discharge includes an infeed, and the infeed draws from the chamber in the lower region of the body. In a yet further feature, the assembly includes an outflow catchment accommodation, and the outflow catchment accommodation is also heated. In a further feature, the outflow catchment accommodation defines a seat for a liner in which to hold molten wax received from the discharge of the body. In another further feature, the outflow catchment accommodation is heated indirectly by thermal conduction. In still another feature, a heat flow path is defined from the heater of the second accommodation to the first accommodation, and from the first accommodation to the outflow catchment accommodation. In yet still another feature, the discharge has an outlet mounted above the outflow catchment accommodation such that, in use a vertical projection of the discharge projects onto the outflow catchment accommodation.

In another feature, the assembly includes a lid for the first accommodation, the lid is movable between open and closed positions, and, when in the closed position, the lid obstructs entry of contaminants into the first accommodation. In a further feature, the discharge of the chamber is mounted to the lid, such that when the lid is removed, the discharge is also removed, whereby cleaning of the discharge is facilitated. In another feature, the assembly includes a pressure source operable to raise pressure inside the first accommodation above external ambient. In still another feature, the pressure source is an air pressure source mounted to pressurize an air space in an upper region of the chamber, thereby also pressurizing wax therein.

In another aspect of the invention there is a depilatory wax dispenser in which the outlet of the discharge stands proud of all adjacent structure and thereby facilitates cleaning thereof. In still another aspect of the invention there is a depilatory was dispenser apparatus that has a discharge and a receptacle support structure in which to hold a disposable receptacle, and in which the receptacle support structure stands proud of all adjacent structure, thereby facilitating cleaning thereof. In another aspect, the receptacle support structure is positioned beneath the outlet of the discharge assembly. In another aspect the receptacle support structure is heated. In a feature of that aspect the receptacle support structure (and thereby the receptacle itself) is heated by conduction of heat from a heat source remote from the receptacle support structure.

In another aspect of the invention there is a depilatory wax dispenser. It has a reservoir for accommodating a charge of flowable wax; a heater operable to heat the reservoir; and a discharge by which the wax may exit the reservoir. The discharge has an inlet and an outlet. There is a temperature sensor mounted adjacent to the discharge inlet.

In a further aspect of the invention there is a depilatory wax dispenser. It has a reservoir for accommodating a charge of flowable wax; a heater operable to heat the reservoir; and a discharge through which wax may exit the reservoir. There is a pressure source, the pressure source being operable to establish a positive pressure in the reservoir relative to external ambient pressure.

In a feature of that aspect of the invention, the source of pressure is an air pump. In another feature, the air pump is operatively connected to pressurize air in the reservoir above wax therein. In still another feature the discharge has an inlet located proximate to a lowermost location in the reservoir. In yet another feature the discharge has an inlet and an outlet, and the outlet is mounted at a higher elevation than the inlet.

In another aspect of the invention, there is a depilatory wax dispenser. It has a reservoir for accommodating a charge of wax; a heater operable to heat the reservoir; and a discharge through which wax may exit the reservoir. The discharge has an inlet and an outlet. The inlet of the discharge is located at a higher elevation than the outlet.

In a feature of that aspect of the invention, the discharge includes a feed conduit, the feed conduit including the inlet; and the feed conduit is mounted eccentrically in the reservoir. In another feature, the reservoir has an upstanding sidewall and has an hydraulic diameter; and the feed conduit is mounted in the reservoir less than ¼ of the hydraulic diameter from the sidewall.

In yet another aspect of the invention there is a depilatory wax dispenser. It has a reservoir for accommodating a charge of wax; a heater operable to heat the reservoir; and a discharge through which wax may exit the reservoir. The discharge has an inlet and an outlet. The inlet is located within the reservoir and is located lower than the outlet. The heater is mounted to heat an upper region of the reservoir distant from the discharge inlet.

In a feature of that aspect of the invention, the assembly includes a pressure source, the pressure source being operable to maintain a pressure within the reservoir greater than ambient pressure. In another feature, the pressure source is an air pump. In a further feature, the air pump is operatively connected to pressurize an airspace above wax contained in the reservoir. In another feature, the reservoir has a body defining a chamber in which to hold molten wax; and the reservoir has a lid mountable to the body in sealing relationship. In still another feature, the discharge is mounted to the lid, whereby when the lid is removed the discharge is also removed.

In another aspect of the invention there is a depilatory wax dispenser. It has a reservoir for accommodating a charge of wax; a heater operable to heat the reservoir; and a discharge through which wax may exit the reservoir. The discharge has an inlet and an outlet. The inlet is located within the reservoir and is located lower than the outlet. The reservoir has a body defining therewithin a chamber in which to contain molten wax. The reservoir has a lid mountable to the body. The discharge is mounted to the lid whereby when the lid is removed from the body the discharge is also removed.

In a feature of that aspect, the discharge includes a feed conduit, the feed conduit includes the inlet, and, when the lid is mounted atop the body the inlet is located distant from the lid in a lower region of the reservoir. In another feature, the wax dispenser includes a pressure source operably mounted to maintain a positive pressure within the reservoir.

In another aspect of the invention there is a method of operation. The method of operation may include one or more of the steps of: heating a main reservoir of wax from a remote heat source by thermal conduction from adjacent structure. The method may include keeping a re-supply of wax, such as an unopened canister (or canisters) of wax heated and ready while using was from the main reservoir. The method may include heating both the main reservoir and the re-supply from the same heat source. The method may include heating a receptacle or receptacle support structure of heated wax that has been dispensed for use. The method may include using a disposable receptacle and disposing of that receptacle after use thereof. It may include repeated use of a spatula, the spatula and the disposable receptacle being used for only one customer, and then disposed after use. The method may include controlling operation of the heater based on temperature sensed at the inlet of the discharge assembly. The method, in any combination of the foregoing steps may include keeping a lid on the main reservoir while in use, thereby discouraging contamination of the wax in the reservoir. The method, in any combination of the foregoing steps, may include maintaining the inside of the reservoir at a pressure higher than ambient. The method in any combination of steps may include urging wax through the discharge with air pressure.

BRIEF DESCRIPTION OF THE ILLUSTRATIONS

Figure 2A:
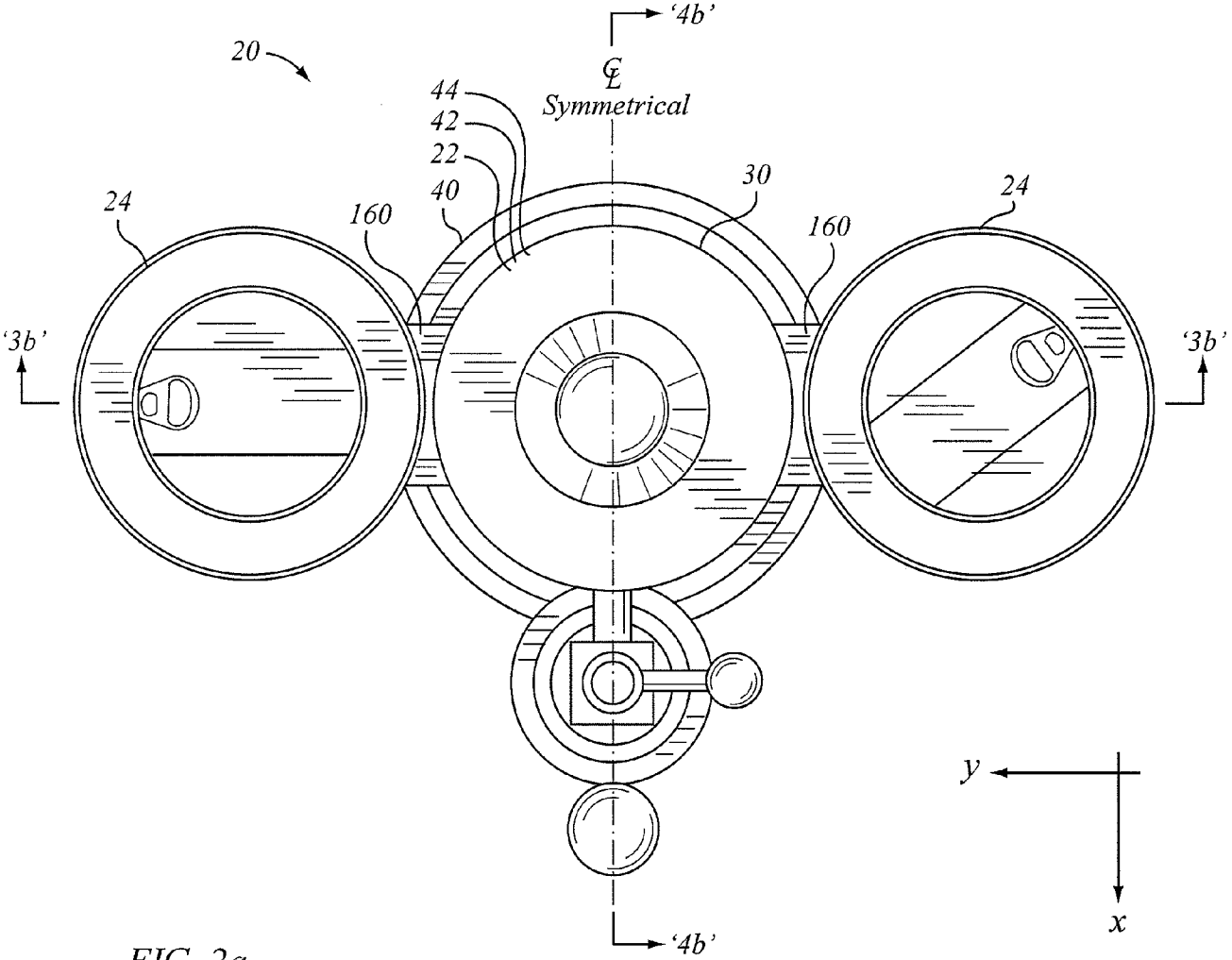
Figure 2B:
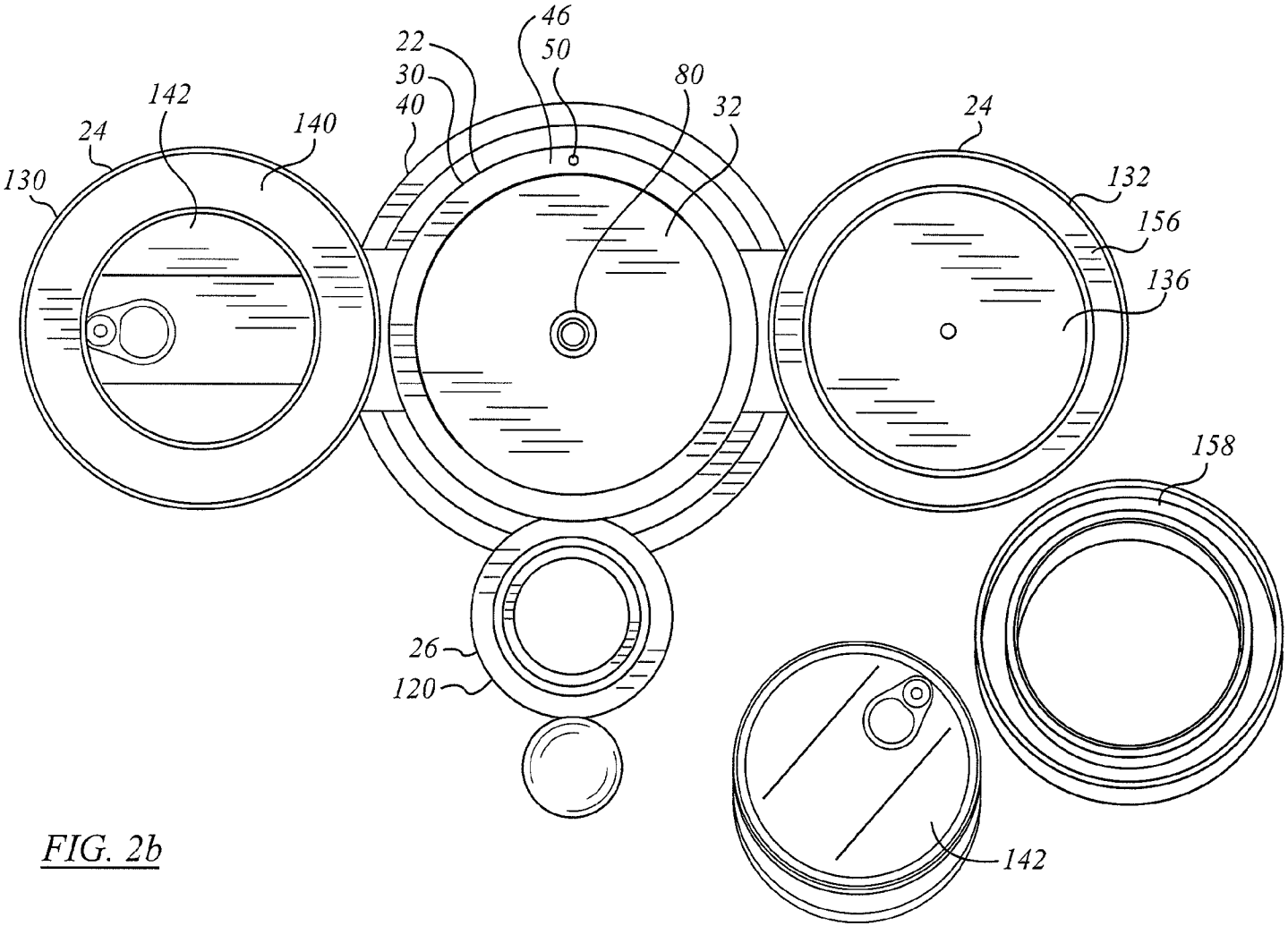
Figure 3A:
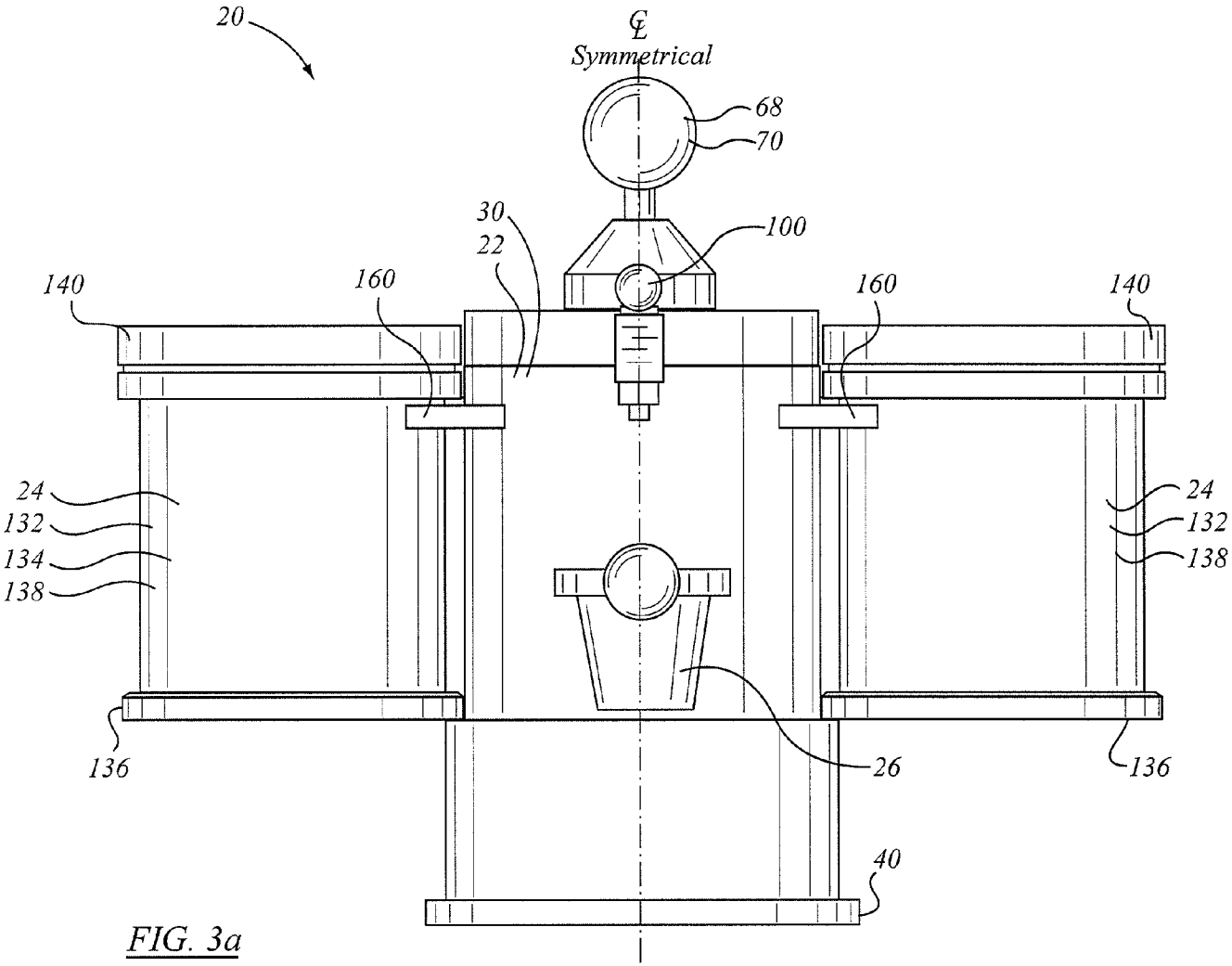
Figure 3B:
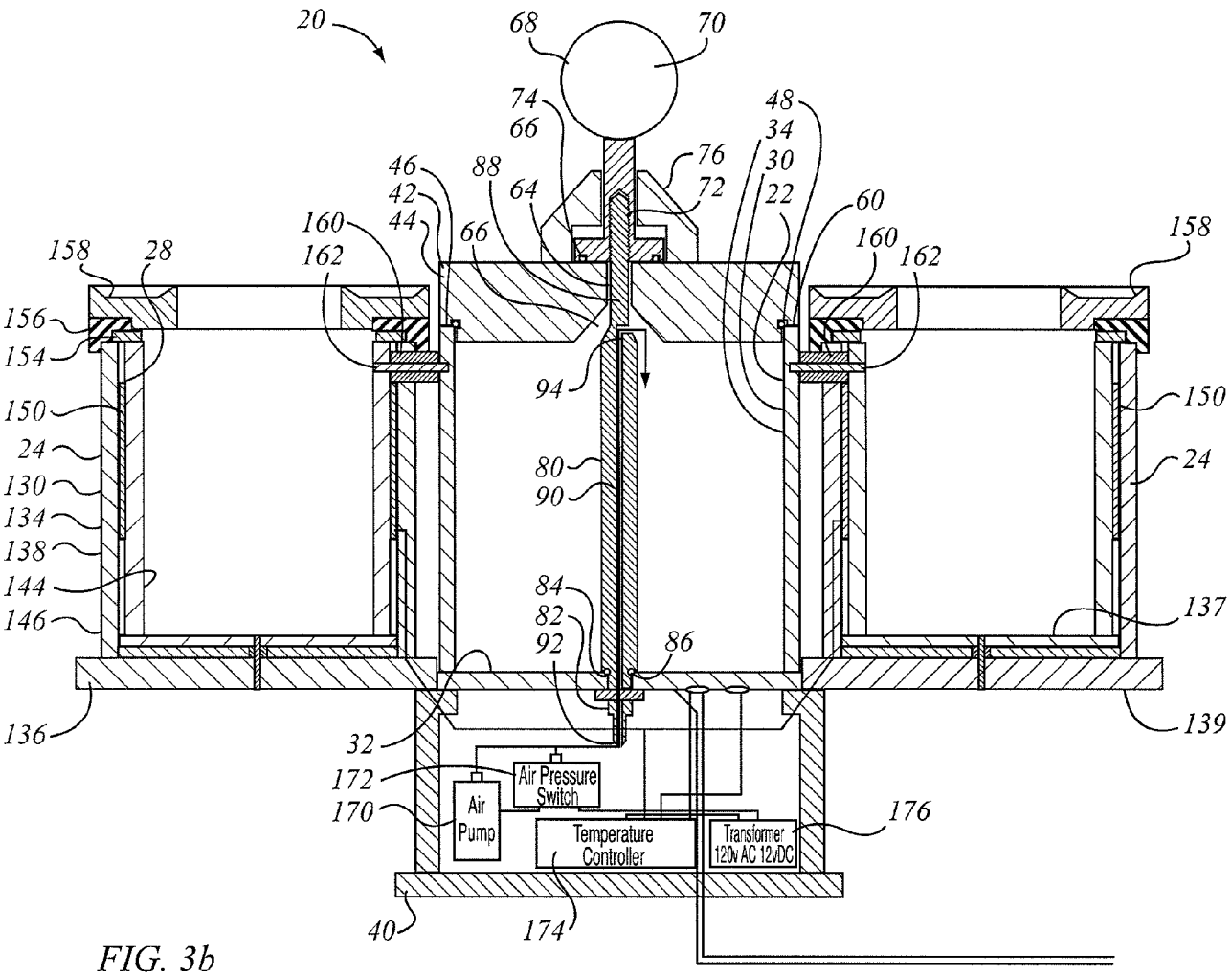

These and other features and aspects of the invention may be explained and understood with the aid of the accompanying illustrations, in which:

FIG. 1 is a perspective view of a dispensing apparatus according to an aspect of the present invention;

FIG. 2*a* is a top view of the dispensing apparatus of FIG. 1 with lid on;

FIG. 2*b* is a top view of the dispensing apparatus of FIG. 1 with lid off, and one of the side resupply canisters removed from its seat;

FIG. 3*a* is a front view of the dispensing apparatus of FIG. 1;

FIG. 3*b* is a longitudinal section of the dispensing apparatus of FIG. 1 taken on section '3*b*-3*b*' of FIG. 2*a;*

Figure 4A:
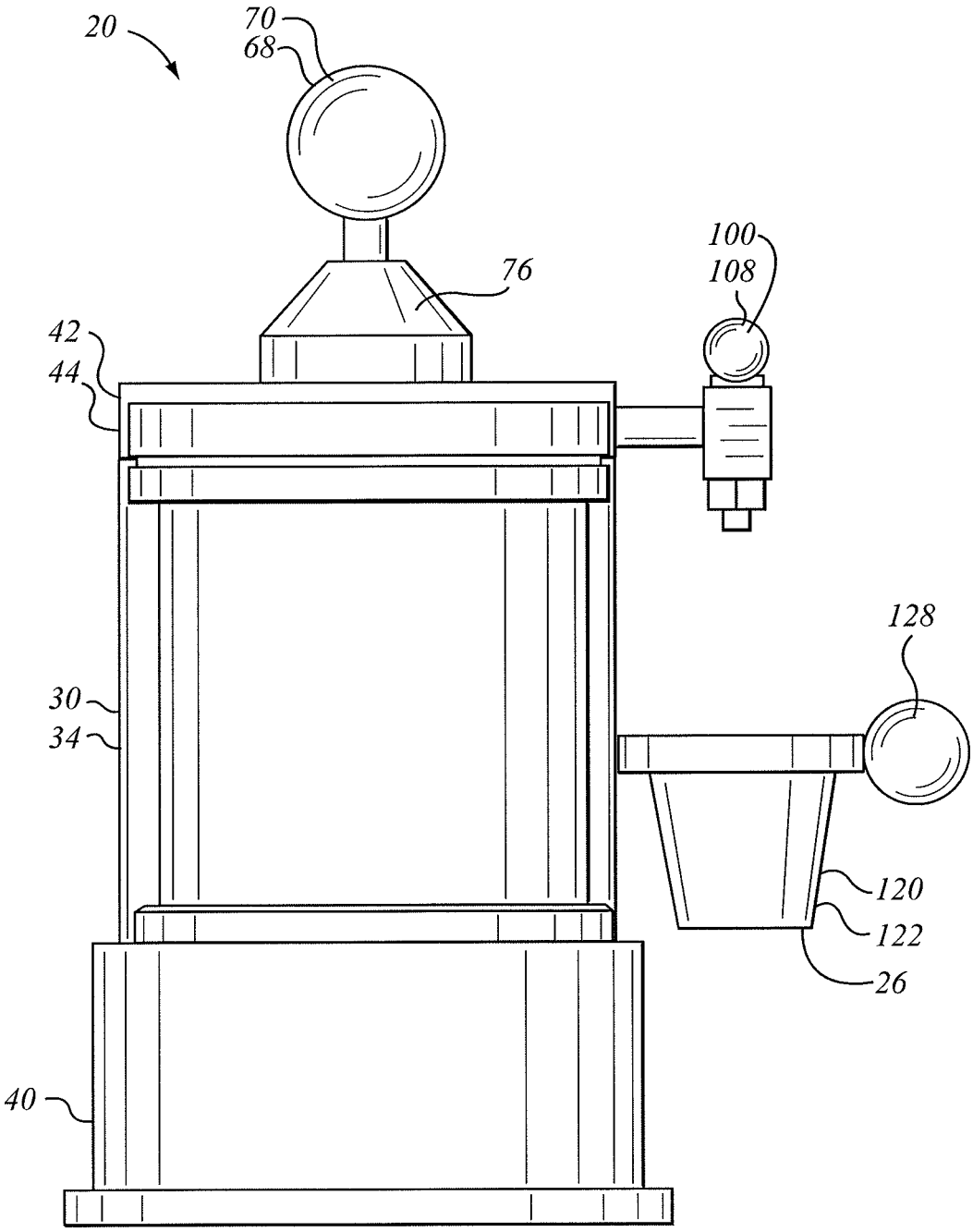

FIG. 4*a* is a side view of the dispensing apparatus of FIG. 1; and

Figure 4B:
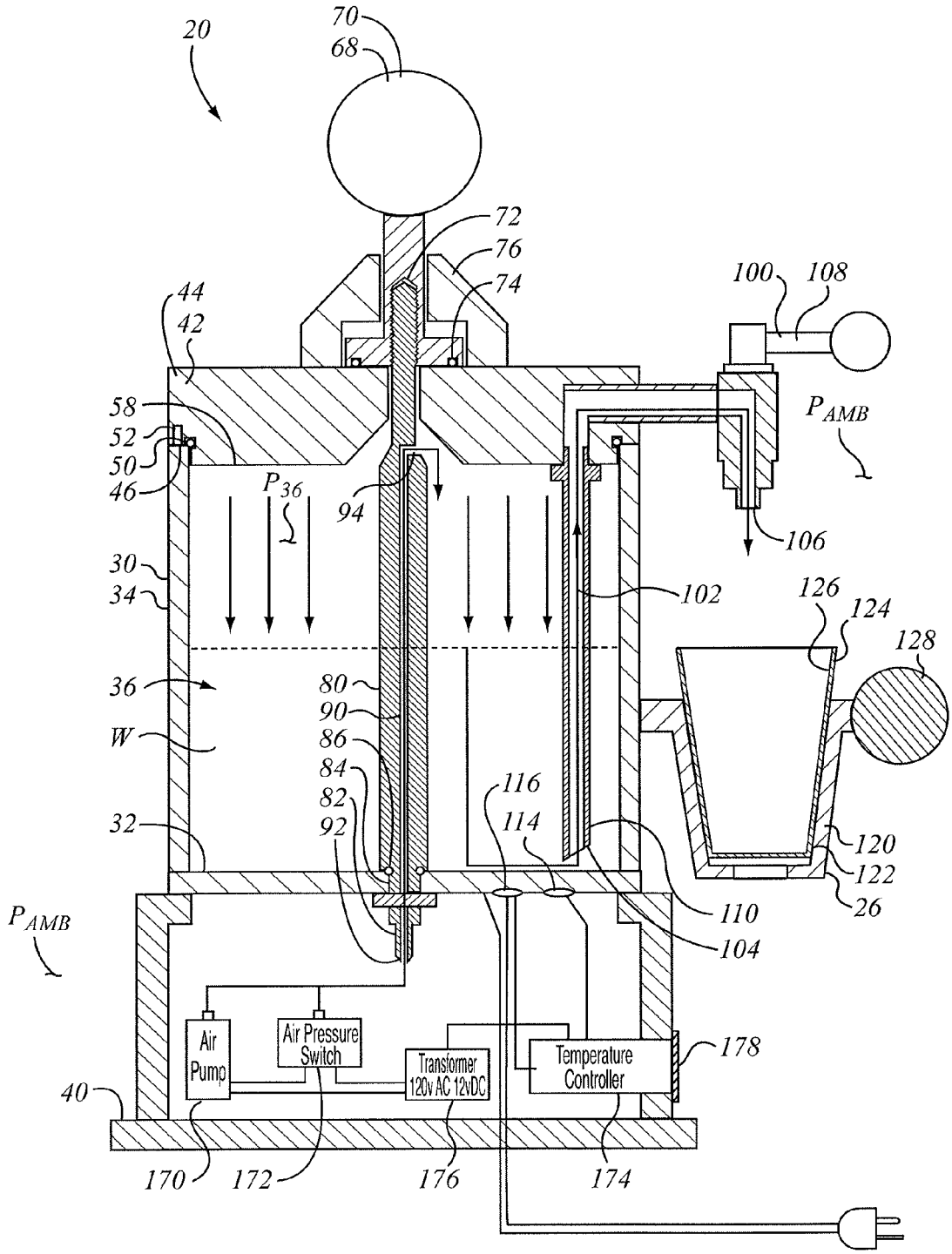

FIG. 4*b* is a side section through the main central chamber taken on section '4*b*-4*b*' of FIG. 2*a*.

DETAILED DESCRIPTION

The description that follows, and the embodiments described therein, are provided by way of illustration of an example, or examples, of particular embodiments incorporating one or more of the principles, aspects and features of the present invention. These examples are provided for the purposes of explanation, and not of limitation, of those principles, aspects and features of the invention. In the description, like parts are marked throughout the specification and the drawings with the same respective reference numerals. The drawings may be taken as being to scale, or generally proportionate, unless indicated otherwise.

The scope of the invention herein is defined by the claims. Though the claims are supported by the description, they are not limited to any particular example or embodiment, and any claim may encompass processes or apparatuses other than the specific examples described below. Other than as indicated in the claims themselves, the claims are not limited to apparatuses or processes having all of the features of any one apparatus or process described below, or to features common to multiple or all of the apparatus described below. It is possible that an apparatus, feature, or process described below is not an embodiment of any claimed invention.

The terminology used in this specification is thought to be consistent with the customary and ordinary meanings of those terms as they would be understood by a person of ordinary skill in the art in North America. The Applicants expressly exclude all interpretations that are inconsistent with this specification, and, in particular, expressly exclude any interpretation of the claims or the language used in this specification such as may be made in the USPTO, or in any other Patent Office, other than those interpretations for which express support can be demonstrated in this specification or in objective evidence of record, demonstrating how the terms are used and understood by persons of ordinary skill in the art, or by way of expert evidence of a person or persons of experience in the art.

The term "molten" is used in several places herein in the context of waxes or waxy materials, and, in particular in the context of depilatory wax. It is intended to indicate that the heated material has reached a sufficiently softened state to be flowable, without necessarily being heated to such an extent that it is a runny liquid. That is, it is no longer firmly solid, but it is also not necessarily completely liquid. It will deform and flatten out under its own weight, like a paste or thick glue or resin. It may be considered a soft rheological solid or semi-solid. If placed in a bowl, it will eventually find its own level, although it may move slowly. For any given wax there is a desirable temperature range in which the wax is maintained in a softened condition, without becoming too liquid, not unlike maintaining butter at a temperature that is soft enough to spread with a spatula or butter knife, but not soft enough to have melted into a runny liquid. For depilatory wax, that suitable temperature range may be fairly narrow. The "molten" material may be highly viscous. In use for such wax the range of moderately elevated temperatures may be in the range that is higher than body temperature (and higher than the effective melting temperature, or softening point, of the wax), and less than 100 C at the outlet. In particular, the outlet temperature for such an application may typically be controlled in the range of about 65-75 C. Internal temperatures may be somewhat higher. Depilatory wax may be both oily and quite sticky, and may easily spread to any surface that may be inadvertently touched. As such maintain the apparatus in a clean state may be quite challenging.

Referring to the general arrangement of FIG. 1, there is a dispenser, or dispenser assembly, indicated generally as 20. Dispenser assembly 20 may be a dispenser for flowable materials, such as highly viscous fluids or rheological solids, and, in particular for materials whose viscosity is strongly temperature sensitive, which may not flow (that is, they may be solidified or substantially solidified) at ambient (typically room) temperature but that may be flowable at moderately elevated temperatures. In one embodiment assembly 20 may be used for dispensing materials such as wax, and, in one particular use, depilatory wax.

In the exemplary embodiment shown, dispenser assembly 20 may include a first part or portion or element or module, identified as a first accommodation 22, a second part or portion or element, or module, identified as a second accommodation 24, and a third part or portion or element or module identified as a third accommodation 26. The dispenser assembly may also include a heat source, or heating element, or heat exchanger element, which may be identified generally as 28.

First accommodation 22 may include a body 30 which includes or defines a containment shell, or wall structure, that has a bottom, or bottom wall, 32 and an upstanding peripherally extending containment wall or sidewall, 34. Items 32 and 34 co-operate to define a chamber 36 in which to contain molten fluid, such as wax, and, in particular, such as depilatory wax. The wall structure defining chamber 36 may also be termed the main or primary, or active, reservoir of assembly 20, and body 30 may be the central structural assembly or module of assembly 20 more generally. In the illustrative embodiment shown, body 30 may have the form of an upright standing circular cylinder that stands upon a platform, or pedestal, identified as a base 40. In the embodiment shown, body 30 and the main structural components thereof may be made from a thermally conductive material, such as a metal. In one embodiment that metal may be mild aluminum. Body 30, or substantial portions thereof, may also be provided with a thermally insulative exterior layer or covering, in whole or in part. Whether an insulating layer, such as a plastic outer wall, is used or not, the exterior surface is substantially clear of obstructions, such as may facilitate washing and maintenance of the unit in an hygienic, clean condition.

Body 30 may include a closure member 42, illustrated as lid 44. Lid 44 seats upon upper rim 46 of sidewall 34, and has a circular seal 48 by which to ensure sealing engagement of lid 44 with rim 46. As may be seen body 30 includes an indexing feature 50 for mating engagement with a corresponding indexing feature 52 of lid 44. Feature 50 may be a pin 54 mounted in rim 46, and feature 52 may be a corresponding socket, such as a blind hole 56, in lid 44. There are many possible alternatives. As may be noted, the central portion 58 of lid 44 stands proud of the outer peripheral land 60, and seal 48 seats at the circumferentially extending shoulder 62 formed where flat horizontal land 60 meets central portion 58. When closed, central portion 58 seats concentrically within peripheral wall 34, and land 60 seats in opposition to rim 46. As seated, indexing features 50, 52 matingly engage, ensuring a unique angular orientation of lid 44 relative to body 30.

Looking again at lid 44, there is a central bore, or aperture, 64, that has a widened lower entrance, or bell-mouth, or rebate, or alcove, or niche, or relief, indicated as 66. A lid securement, or lid securement assembly, is shown generally as 68. Lid securement assembly 68 includes a tightening grip, or handle 70 having an internally thread blind bore 72, and a seal 74. Handle 70 is prevented from separating from lid 44 by a retainer, which may have the form of a housing 76. Handle 70, or the shaft upon which it is mounted, may have an aperture formed therethrough to permit the installation of a rod or bar, or the shaft of a screw driver, for example, such that, in the event that the seal of the lid to the body of the assembly should become sticky the rod or bar may be passed through to provide the operator with enhanced leverage to removed lid 44.

Body 30 has a central rod or central mandrel 80. At its first, or lower, end mandrel 80 has a reduced diameter stub or shank 82 which seats in, and extends through, a mating aperture 84 in bottom wall 32, and is secured in place with a locknut. Another O-ring seal 86 is located at the shoulder of the stub to provide a seal about aperture 84. At its second, or upper, end mandrel 80 is again narrowed, in this instance to an end shank 88, which is externally threaded along its most distal portion. Mandrel 80 is hollow to the extent that it has a central bore defining an air flow conduit or passageway 90, that passageway having an inlet at the bottom end, as indicated at 92, and an outlet 94 at the top end short of the threaded shank.

Looking at the cross-sectional view of FIG. 4*b*, a discharge, or outflow, or discharge assembly, 100 is also mounted to lid 44. Discharge assembly 100 defines a flow path, or passageway, or conduit, identified as 102, however named, by which the contents of chamber 36 may exit, leave, egress, or otherwise flow out of chamber 36 and thereby be dispensed, the direction of flow being indicated by the arrows on flow path 102. It has an inlet 104 inside chamber 36; an outlet 106 outside chamber 36, and a control or governor, such as may be identified as a gate, spigot, valve, or tap 108 intermediate inlet 104 and outlet 106 by which to regulate flow through passageway 102. Tap 108 is a flow governor that is movable between a closed (no flow) position or condition, and an open position.

Discharge assembly 100 may include an infeed, such as may include an intake pipe 110. Pipe 110 may have a first end mounted to lid 44, and a second, distal, end distant from lid 44. As shown, inlet 104 may be at the distal end of pipe 110, and, as installed, may be proximate to bottom 32 such that inlet 104 may remain submerged until the reservoir, that is chamber 36, is substantially empty. That is, inlet 104 is located in a lower, or substantially lowermost region of chamber 36 (and of body 30) in use. In one embodiment, pipe 110 may be mounted eccentrically relative to the center of chamber 36. That is, assuming that chamber 36 has a cross section, a centroid, and an hydraulic diameter $D_h$, or, if circular, an actual diameter, there is a radial distance from the center (or centroid) of the chamber to the surrounding peripheral containment wall. Taking the radius as being half the diameter (or hydraulic diameter, as may be), the centerline of pipe 110 is then radially closer to peripheral containment wall 34 than to the centroid (that is, in a right cylinder, the central axis of revolution). In one embodiment the centerline of pipe 110 is between 10% and 30% of the length of the radius from the outer wall. In one embodiment is is about ⅕ to ¼ of the radius from the wall. In one embodiment pipe 110 may have an internal diameter of 8 mm to 10 mm, and the spigot and discharge passage may have an internal diameter of 12 mm.

When lid 44 is removed, discharge assembly 100 is also removed, and, given the relative simplicity of construction, discharge assembly 100 can then be cleaned relatively easily even without emptying chamber 36 or tipping body 30. At the same time, too, it may be noted that when lid 44 is removed, chamber 36 may also be easily cleaned, given that it has the form of a smooth-walled bucket, or cylinder with a central mandrel. A temperature sensor 114 may be mounted to bottom wall 34 underneath inlet 104, in effect measuring the inlet temperature of the molten material. An over-temperature sensor and limit switch 116 is also mounted at or near this location. For the application of maintaining depilatory wax suitably warm, the over-temperature switch may be set at 75 C, such that if normal temperature control should fail, the machine will automatically shut off. During normal operation the inlet temperature for depilatory wax may typically be in the range of 68-70 C.

When lid 44 is positioned in place in it closed position, as shown in FIGS. 3*b* and 4*b*, the male external thread of upper end shank 88 of mandrel 80 are engaged by the female internal threads of handle 70, and, as tightened, axial tension develops in mandrel 80 sufficient to compress O-ring seals 74 and 86 as peripheral land 60 engages upper rim 46. When so engaged, chamber 36 is sealed, and may be pressurized, as explained below. To the extent that fluid, or quasi-fluid matter, such as molten depilatory wax, has a higher pressure $P_{104}$ at inlet 104 than external ambient $P_{amb}$ at outlet 106, that fluid may tend to flow outwardly through passageway 102. On turning spigot handle 112 appropriately, the flow governor 108 is then movable between the closed (no flow) position or condition, and an open position whether partially or fully open as may be suitable, in which flow is permitted through the discharge. Lid 44 may be provided with a pressure relief valve (not shown). One may note that even without removing lid 44 the outlet portions of discharge assembly 100, namely outlet 106, tap 108 and spigot handle 112, are mounted in an exposed location. They jut out from, i.e., stand forward of, or proud of, and clear of, all other adjacent structure such that they are well exposed to facilitate cleaning. That is, the pouring or dispensing outlet is not mounted within a housing or shell, but is mounted, and extends, externally of the shell of the unit.

Dispenser assembly 20 also includes third accommodation 26, which defines a receptacle or receptacle support structure 120 which defines a seat 122 in which a receptacle 124 such as a disposable paper cup 126 may be placed. Seat 122 may have a conically tapered sidewall. The shape of the receptacle, cup 126, as indicated matches the size and shape of seat 122 such that a substantial portion of the surface area is in contact with the seat. In the embodiment illustrated, paper cup 126 may typically be of the size of a paper coffee cup, such as may hold, in one example, perhaps 50 ml-150 ml of dispensed material at a time. Support structure 120 may be made of thermally conductive material. While copper or other high thermal conductivity metals may be used, the inventors have found that aluminum provides good thermal conductivity. The metal provides a thermally conductive path between body 30 and receptacle 124. It may be noted that seat 122 has a large sidewall surface area extending downward to the bottom of the support structure such that a cup 126 resting therein may tend to be heated over the full depth of the fluid collected in the cup. A second handle 128 is mounted to the front of support structure 120 to permit an operator to steady assembly 20 with one hand while turning spigot handle 112 to open or close the valve. As may be seen in FIG. 2*a*, given the relationship of indexing features 50 and 52, lid 42 can seat in only one position relative to support structure 120. As such, a vertical projection of outlet 106 projects onto the footprint of receptacle support structure 120, meaning that gravity will direct the outflow of discharge assembly 100 into a receptacle 124 mounted in support structure 120. The central bottom of support structure 120 is open, so that if no receptacle 124 is mounted therein, wax (or other fluid) will not collect on the structure.

The flow from discharge assembly 100 to receptacle 124 is one way. Wax (or such other material as may be dispensed) cannot flow back uphill into chamber 36, and once dispensed has no further contact with chamber 36 or with the remainder of the contents of the reservoir of material yet to be dispensed. Given that the lid is sealed, and the only outlet is the spout, the chance of contamination of the reservoir, and the opportunities to contaminate the reservoir, may tend to be reduced. Further, there is clear vertical separation between outlet 106. Support structure 120 extends forwardly clear of the rest of the structure of assembly 20, such that it is easily accessible for cleaning. It is not obstructed on left or right. The clearance from discharge 100 gives clear access from above. There is no obstruction from below. Support structure 120 stands out on a cantilever such that it projects away from, that is, it stands forwardly proud of, not only body 30, but also of all other nearby structure and is thereby exposed to facilitate access during operation and to facilitate cleaning afterward. The remainder of the structure is sealed, and has smooth external surfaces which may also facilitate cleaning. That is, the seat and the disposable receptacle are not mounted within a housing or shell, but are mounted, and extend, externally of the shell of the unit. The root of support structure 120 is shaped to conform to the external shape of body 30, and support structure 120 is mounted to body 30 in thermally conductive relationship therewith. In the embodiment shown, attachment is by threaded fasteners, although the parts could be welded together, or made as a single cast aluminum (or other suitable metal) monolith.

The second part or, or module, identified as a second accommodation 24 is mounted to the first part or module. In the embodiment there is a left hand module 130, and a right hand module 132. Each being mounted, or hung from and to one side of, body 30 of the main, active, or primary, reservoir. Second accommodation 24 may have the form of either of modules 130 and 132, or both together. Although two such modules are shown, there need not be more than one, and there could be more than two. In the embodiment shown two such modules are convenient inasmuch as the main reservoir of chamber 36 may have a volumetric capacity slightly larger than two standard containers of wax, such that two containers of wax would be considered a full re-fill of chamber 36. That is, chamber 36 may have a volume of somewhat over 2 L, where each replacement canister has a volume of 1 L and a mass of about 800 g. of wax. A typical salon may use 1 L-2 L of wax in a day. In the embodiment shown, there is left and right hand symmetry about the central vertical plane x-z plane. Inasmuch as modules 130 and 132 are the same, other than to the extent that they are left and right handed, and therefore a description of one may be understood also to be a description of the other. Considering left hand module 130 as being representative, module 130 has a body 134 that includes a base 136, and upstanding, peripherally extending sidewall 138 and a closure member, or retainer 140. In the embodiment shown, body 134 may have the form of a right circular cylinder, and defines therewithin a containment vessel or seat. Unopened re-supply containers of material are indicated as 142. As noted container 142 may contain a phase changing material, such as wax, that is transformed from a solid or substantially solid, non-readily-flowing state at one temperature, to a liquid, or substantially liquid, flowable state at a warmer temperature.

Base 136 may include a highly thermally conductive inner layer 137 and an outer layer 139. Outer layer 139 need not be thermally conductive, and may be thermally insulative. Sidewall 138 may include, or may have mounted to it, a source of heat such as heater 28. While it would be possible to have an external source of heat, such as hot glycol heated elsewhere, and a heat exchanger, in the embodiment illustrated the heat source may be an electric heating element mounted within body 134. In the embodiment illustrated, base 136 may be made of a thermally conductive material such as solid aluminum, or may be made of a thermally insulative material. Sidewall 138 may include an inner wall 144, and outer wall 146. The relative thicknesses of walls 144 and 146 may not be to scale. A heating element, which may be a rubberized flexible heating array, or heating element, 150 having electric heating members, may be wrapped externally about inner wall 144, such that inner wall 144 may be heated thereby. Either or both of inner wall 144 and outer wall 146 may be made of a thermally conductive material, again, such as aluminum. Outer wall 146 may be made of a less thermally conductive material, and may be made of a thermal insulator. Alternatively, a layer of thermal insulation may be wrapped about heating element 150 within outer wall 146. Inner wall 144 may have a radially outwardly extending flange, or may be surmounted by a cap ring, either being indicated as 154. As shown, the assembly is welded at top and bottom to prevent leakage. The top of the wall is overlain be an annular cap ring 156 which is easily cleaned. Finally, there is a retainer 158 which is removed to permit the introduction of re-supply container 142. Retainer 158 has a radially inwardly extending wall or flange that captures container 142 in seat 148. A see-through plastic cap or dome (not shown) may cover the central aperture in retainer 158. As with the exterior wall of main reservoir body 30, the exterior of wall 146 is smooth and substantially clear of obstructions to facilitate cleaning.

Each of modules 130 and 132 is mounted to the main body 30 by a structural member (or members) defining a thermally conductive bridge 160. Thermal bridge 160 may be made of a thermally conductive material. An example of such a material is aluminum, including mild 1100 aluminum. A first end of thermal bridge 160 is in thermally conductive attachment to body 134, and, in particular, to thermally conductive inner wall 144, which is itself in thermally conductive close contact with heating element 150. A second end of thermal bridge 160 is mounted in thermally conductive attachment to body 30 of the main, active, reservoir. In the embodiment shown, module 130 (or 132) is secured to main body 30 by threaded fasteners as indicated at 162. The various modules could be welded together, or made as a casting.

By this means a thermally conductive heating path is established from heating element 150 through module 130 (or 132 as may be), into the main reservoir of body 30, and thereby into the material to be maintained in a molten state that is contained within body 30. The thermally conductive path also extends to discharge assembly 100. That is, one problem with highly viscous depilatory wax is that it may tend to solidify in an outlet tap. However, as shown the outlet tap is made of thermally conductive material, such as aluminum, and is thereby maintained at a sufficiently high temperature to maintain the wax in a flowable condition, even when the tap is closed. Even if the machine is turned off, and the wax solidifies in the outlet passageway, once the machine is turned on again, the heat in the discharge assembly will, after some time, heat and re-melt the wax in the passageway. If that is unsatisfactory, lid 44 can be removed, permitting the entire discharge assembly to be washed in hot water, such as water having a temperature in excess of 75 C.

In addition to providing a footing for assembly 20 more generally, base 40 may define a housing or shell, or enclosed space in which to mount control devices and circuitry. For example, there may be, mounted within base 40 an air pump 170; an air pressure switch 172; a controller 174; and a transformer 176 connected to receive external line power, whether at 60 Hz 120 VAC, or at 50 Hz 220 VAC.

Air pump 170 draws air from external ambient (base 40 not being sealed), and feeds it into the dome in lid 44 through the passageway in mandrel 80. Since chamber 36 cannot be filled higher than the dome in lid 44, the air pressure $P_{36}$ established there will be established above the molten wax, W, whatever the level of wax may be in chamber 36. Appropriate flow can be obtained with even modest pressure levels. Air pump 170 may operate at ½ psig-1 psig in normal operation. In one embodiment is has a maximum pressure of 4.5 psig. Overpressure switch 172 is operable to shut off air pump 170 in the event of a failure of the pressure control of pump 170. Overpressure switch 174 may be set, for example, at 5 psig. As noted above, lid 44 may also have a pressure relief valve as a further back-up to over-pressure switch 172. It is known to pump wax and oils with pumps. However, in the embodiment illustrated, the working fluid, being wax, does not pass through the pump. Rather, the pump is upstream of the wax, and only pumps air. Thus the wax cannot make a sticky, hard-to-clean, mess inside the pump. Moreover, the use of the air pump applies an even, gentle pressure to the entire top surface of the wax, and, given that the flow is slow and the sidewalls are heated, over a period of hours the wax recedes in chamber 36 evenly under gravity, such that the walls are substantially self-cleaning in use.

Controller 174 operates to control air pump 170, and also to cycle operation of the heating elements in response to the temperature sensed at temperature sensor 114. It also controls operation of air pump 170. Controller 174 is mounted such that its display and control key-pad module 178 is externally accessible, most typically at the front of base 40.

An operator may choose the desired molten wax temperature. The apparatus will then heat the wax until the temperature is achieved, at which time the keyboard display will indicate that the target temperature has been achieved. The controller is an "on-off" controller that has a hysteresis loop, which, typically, is a 2 degree range, from 1 C below target temperature to 1 C above target temperature. Alternatively, or additionally, the controller may use a timer to establish a minimum "off" time, to prevent the controller from cycling the heating elements too rapidly. Either approach will yield a saw-tooth time v temperature characteristic. In apparatus 20, the function of maintaining suitable temperature in the main reservoir, or active supply, is combined with the function of pre-heating the next batch of wax, using a single heating system. When initially activated, heating elements 150 may each operate at a maximum power of 175 W, or 350 in total. The heaters may have three different manual settings for 175 W, 150 W and 125 W each. When operating temperature is reached, the controller may reduce the power to 125 W, and may run that power on a partial duty cycle, which may be roughly 20-25% of the time "on", and 75-80% of the time "off". At steady state, a typical duty cycle may be 3-4 minutes "on" and 15 minutes "off", such that the machine may operate at an average steady state power equivalent to about 50-60 W. This is equivalent to the heat of a relatively dim conventional incandescent bulb. Although controller 174 may be a digital processor control, the control functions are sufficiently simple that an analog circuit could also be used, with temperature selection being by thermostat rather than a digital keypad, and a multi-position switch being used for power range selection.

It may be noted that heating of the main reservoir is indirect. There is no electrical or other heating element mounted to the main reservoir body 30 itself. The reservoir is heated externally, by an external source of heat, through thermal conduction from adjacent intermediate structure, in this case the pre-heat modules 130 and 132. Further, a single heat source (or sources) at the re-fill reservoir seat heat not only the re-fill containers in module 130 (or 132), but also the main reservoir i.e., body 130; the output receptacle support structure 120; and the discharge assembly 100. The indirect heating of the main reservoir, externally by thermal conduction, will occur whether there are canisters of re-supply wax in the re-supple pre-heat seats of modules 130, 132 or not. In the embodiment, primary heating is of the re-supply seat, with the main, active reservoir being more distant from the heating element than the re-supply pre-heat seat. In an alternate embodiment or embodiments, each of these heating functions could be separate, each module could have a separate heater, and a separate temperature control. However, a single heating circuit with elements in each pre-heat module, is relatively simple.

A common problem with depilatory wax is that it takes a long time for a canister of wax to melt. In this context, "a long time" may exceed half an hour, depending on the size of the heater. When the current main supply has been consumed, it may be convenient to have a pre-melted supply ready to hand. In some apparatus a canister of solid wax is opened and placed in a seat in an inverted, or predominantly inverted, orientation, typically above some kind of grill or collection apparatus. When the canister is heated, the wax melts and drips down into the collection apparatus, whence it is dispensed. In other apparatus the wax may be emptied upside down into the unit as a slug of solid wax. In the view of the inventors this may tend to lead to an apparatus that is one or both of (a) unnecessarily complicated; and (b) more difficult to clean.

As described, apparatus 20 includes a re-supply pre-heating function, namely by the placement of a still sealed (i.e., unopened) canister of re-supply wax in heated seat 148. When the supply of wax in the active main reservoir chamber 36 is running low, the pre-heated canister is opened and poured into chamber 36. The location of heating element 150 about wall 144 ensures that the pre-heated wax is at least as hot as the wax in chamber 36. Since the canisters are unopened in the pre-heat modules, when they are removed there is no sticky residue to clean out of seat 148, and a further resupply canister may be placed in seat 148 for the next re-fill.

The use of a pressurized tank permits simplification of the outflow, and, by permitting the outflow to be simplified and mounted to lid 42, facilitates ease of cleaning. The only moving part is the valve. Infeed pipe 110 is within chamber 36, and so is maintained at the internal temperature of chamber 36. The inventors have observed empirically that the circulation of molten wax in chamber 36 appears to be aided when body 30 is heated from the top, rather than from the bottom. As shown in the Figures, thermal bridge 160 is mounted to an upper region of body 30, rather than to a lower region thereof. Expressed differently, thermal bridge 160 is mounted adjacent to the upper end of body 130, proximate rim 46, and distant from bottom wall 32. Bridge 160 may be located at a height that is within ¼ of the overall height of chamber 36 from the top thereof. A further empirical observation by the inventors is that the circulation of molten wax in chamber 36 is such as to encourage placement of infeed 110 relatively close to the outer wall (as described above). A further observation is that location of the temperature sensor adjacent inlet 104 of discharge assembly 100 may tend to provide satisfactory operation. When the unit is heating, if the wax in chamber 36 is in its solidified condition, the wax that melts most quickly will tend to be the wax most closely adjacent to sidewall 34 (which is a large, relatively thick wall aluminum heat conductor), and of that wax near the wall, the wax closest to bridge 160 may tend to melt most quickly. Placement of infeed 110 relatively close to the outer wall (for example, less than ⅓ or ¼ of the radius of chamber 36 therefrom) means that the discharge assembly may come to working temperature faster, and be operable to discharge wax sooner, than if placed more centrally in the chamber. An initial amount of wax may be discharged to disposable cup 126 for use, and while it is being used the remainder of the wax in chamber 36 may continue to melt.

The overall assembly may have the general appearance of a coffee urn with two cylinders on either side that contain re-fill material. The exterior of the unit is substantially free of adornment or of external fittings or other obstructions that do not facilitate easy cleaning. Maintaining the predominantly smooth metal exterior in a clean condition may tend to promote both actual hygiene, and also the perception of hygiene by customers.

In use, the attendant pours as much wax as may be needed into disposable cup 126. The attendant may then use one spatula to spread that wax, rather than needing a new spatula for every dip of wax. Waste of wooden spatulas and waste tissue may be reduced. During use, the wax in cup 126 is maintained at a suitable warm temperature. If more wax is required, it can be poured from outlet 106 contamination by the wax remaining in cup 126. When the work is finished, the operator removes the disposable cup and disposes it. When the next customer arrives, a new clean disposable cup is placed in seat 124, and new, fresh, uncontaminated wax is poured from outlet 106. When the supply in chamber 36 is exhausted, the pre-heated tins in modules 130, 132 are removed, opened, and poured into chamber 36, without having to wait a long time for the wax to melt. New canisters 42 are placed in seats 148 in a normal, upright position (it could be upside-down, but it matters not since the canister is closed). The process continues. Since the solid wax in the canisters has low thermal conductivity, and since operation of the heating elements is based on the temperature sensed adjacent inlet 104, the electrical power supplied to the heating units will be increased if temperature at inlet 104 falls, tending to provide greater heating. Alternatively, when new canisters of solid wax are placed in modules 130, 132, the operator may select an elevated, or maximum, heating setting to encourage more rapid melting, and controller 174 will cut back that power setting at such time as the temperature adjacent inlet 104 exceeds the desired target temperature hysteresis band.

If the wax is too cold, it does not flow well or apply well. If it is too warm, it becomes too runny, and may drip on a customer's body, which can be quite painful. The unit may be of substantial weight, in some embodiments more than 20 lbs or 10 kg. In those embodiments, more than half of the weight of the unit is aluminum. In some embodiments more than ¾ of the weight is aluminum. The large thermal mass, once at the desired steady state temperature, may also tend to assist in maintaining an even temperature in the wax. Further, in a conventional approach where an open wax container is heated upon a heating element, as the volume of wax remaining in the container decreases, the temperature of the wax may tend to rise, leading, again, to the wax being too runny, and the increased likelihood of dripping on the customer.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details but only by the appended claims.

We claim:

1. A depilatory wax dispenser assembly comprising:

a first accommodation, a second accommodation, and a heater;

said first accommodation defining a chamber in which to contain flowable wax, said chamber having a discharge through which to conduct flowable wax;

said second accommodation defining a seat in which to heat a reserve supply of wax for replenishing said chamber;

said heater being mounted to said second accommodation;

said dispenser having a heat flow path from said heater to said second accommodation, and from said second accommodation to said first accommodation.

2. The depilatory wax dispenser assembly of claim 1 wherein said second accommodation is linked to said first accommodation by a thermal conduction bridge.

3. The depilatory wax dispenser assembly of claim 1 wherein said assembly includes a third accommodation defining a second seat in which to heat a second reserve supply of wax for replenishing said chamber.

4. The depilatory wax dispenser assembly of claim 3 wherein said assembly includes a second heater mounted to said second seat, and said second heater also indirectly heats said first accommodation.

5. The depilatory wax dispenser assembly of claim 3 wherein said first and second seats are mounted symmetrically to said first accommodation.

6. The depilatory wax dispenser assembly of claim 1 wherein:

said first accommodation has a body defining a surrounding wall of said chamber;

said second accommodation is mounted adjacent to said first accommodation;

said body having a lower region and an upper region; and said bridge being mounted to said upper region of said body of said first accommodation.

7. The depilatory wax dispenser assembly of claim 6 wherein said discharge includes an infeed, and said infeed draws from said chamber in said lower region of said body.

8. The depilatory wax dispenser assembly of claim 1 further comprising an outflow catchment accommodation, and said outflow catchment accommodation is also heated.

9. The depilatory wax dispenser assembly of claim 8 wherein said outflow catchment accommodation defines a seat for a liner in which to hold molten wax received from said discharge of said body.

10. The depilatory wax dispenser assembly of claim 8 wherein said outflow catchment accommodation is heated indirectly by thermal conduction.

11. The depilatory wax dispenser assembly of claim 8 wherein a conduction heat flow path is defined from said heater of said second accommodation to said first accommodation, and from said first accommodation to said outflow catchment accommodation.

12. The depilatory wax dispenser assembly of claim 1 wherein said assembly includes a lid for said first accommodation, said lid being movable between open and closed positions, and, when in said closed position, said lid obstructing entry of contaminants into said first accommodation; and said discharge of said chamber is mounted to said lid, such that when said lid is removed, said discharge is also removed, whereby cleaning of said discharge is facilitated.

13. The depilatory wax dispenser assembly of claim 1 wherein said assembly includes a pressure source operable to raise pressure inside said first accommodation above external ambient.

14. The depilatory wax dispenser of claim 13 wherein said pressure source is an air pressure source mounted to pressurize an air space in an upper region of said chamber, thereby also pressurizing wax therein.

15. The depilatory wax dispenser of claim 1 wherein said discharge has an inlet and an outlet, said outlet is mounted at a higher elevation than said inlet; and said inlet is located proximate to a lowermost location in said chamber.

16. The depilatory wax dispenser of claim 1 wherein said first accommodation defines an upright cylinder having a centroid, said discharge includes a feed conduit; and said feed conduit is mounted eccentrically in said chamber relative to said centroid.

17. The depilatory wax dispenser of claim 16 wherein said first accommodation has an upstanding sidewall and has an hydraulic diameter; and said feed conduit is mounted in said chamber less than ¼ of said hydraulic diameter from said sidewall.

18. The depilatory wax dispenser of claim 1, wherein:

said discharge has an inlet and an outlet; and a temperature sensor is mounted adjacent to said inlet of said discharge.

19. The depilatory wax dispenser of claim 1, wherein said dispenser has a pressure source, said pressure source being operable to establish a positive pressure in said chamber relative to external ambient pressure.

20. The depilatory wax dispenser of claim 19 wherein said source of pressure is an air pump operatively connected to pressurize air in said chamber above wax therein.

21. The depilatory wax dispenser of claim 1, wherein:

said chamber defines a reservoir for accommodating a charge of the flowable wax;

said discharge having an inlet and an outlet;

said inlet being located within said reservoir and being located lower than said outlet; and said heater being mounted to heat an upper region of said reservoir distant from said inlet of said discharge.

22. The depilatory wax dispenser of claim 21 further comprising a pressure source, said pressure source being operable to maintain a pressure within said reservoir greater than ambient pressure.

23. The depilatory wax dispenser of claim 1 wherein said reservoir has a lid mountable to said body in sealing relationship, and said discharge is mounted to said lid, whereby when said lid is removed said discharge is also removed.

24. The wax dispenser of claim 23 wherein said discharge includes a feed conduit, said feed conduit includes said inlet, and, when said lid is mounted atop said body said inlet is located distant from said lid in a lower region of said reservoir.

25. The wax dispenser of claim 23 wherein said wax dispenser includes a pressure source operably mounted to maintain a positive pressure within said reservoir.

26. The depilatory wax dispenser of claim 1 wherein:

said discharge has an inlet and an outlet, said outlet is mounted at a higher elevation than said inlet; and said inlet is located proximate to a lowermost location in said chamber;

said first accommodation defines an upright cylinder having an upstanding sidewall, said cylinder having a centroid, said discharge includes a feed conduit, said feed conduit including said inlet; and said feed conduit being mounted eccentrically in said chamber relative to said centroid; and said first accommodation has an hydraulic diameter; and said feed conduit is mounted in said chamber less than ¼ of said hydraulic diameter from said sidewall.

* * * * *